US007925385B2

(12) United States Patent
Stavale et al.

(10) Patent No.: US 7,925,385 B2
(45) Date of Patent: Apr. 12, 2011

(54) METHOD FOR OPTIMIZING VALVE POSITION AND PUMP SPEED IN A PID CONTROL VALVE SYSTEM WITHOUT THE USE OF EXTERNAL SIGNALS

(75) Inventors: Anthony E. Stavale, Victor, NY (US); Brian S. Verdehem, Sugarland, TX (US)

(73) Assignee: ITT Manufacturing Enterprises, Inc, Wilmington, DE (US)

( * ) Notice: Subject to any disclaimer, the term of this patent is extended or adjusted under 35 U.S.C. 154(b) by 808 days.

(21) Appl. No.: 11/704,891

(22) Filed: Feb. 9, 2007

(65) Prior Publication Data

US 2007/0212230 A1 Sep. 13, 2007

Related U.S. Application Data

(60) Provisional application No. 60/780,547, filed on Mar. 8, 2006.

(51) Int. Cl.
*G05D 7/00* (2006.01)
*F04B 49/00* (2006.01)

(52) U.S. Cl. ..... 700/282; 417/43

(58) Field of Classification Search ..... 700/282; 417/43

See application file for complete search history.

(56) References Cited

U.S. PATENT DOCUMENTS

| | | | | |
|---|---|---|---|---|
| 4,358,821 | A | | 11/1982 | Niemi |
| 4,990,058 | A | | 2/1991 | Eslinger |
| 5,213,477 | A | | 5/1993 | Watanabe et al. |
| 5,229,699 | A | | 7/1993 | Chu et al. |
| 5,394,322 | A | | 2/1995 | Hansen |
| 5,560,344 | A | * | 10/1996 | Chan ..... 123/515 |
| 5,616,998 | A | | 4/1997 | Sepehri et al. |
| 6,424,873 | B1 | | 7/2002 | Przybylski |
| 6,464,464 | B2 | | 10/2002 | Sabini et al. |
| 6,546,295 | B1 | | 4/2003 | Pyotsia et al. |
| 6,554,198 | B1 | | 4/2003 | Hull et al. |
| 6,591,697 | B2 | | 7/2003 | Henyan |
| 6,709,241 | B2 | | 3/2004 | Sabini et al. |
| 6,715,996 | B2 | | 4/2004 | Moeller |
| 6,776,584 | B2 | | 8/2004 | Sabini et al. |
| 2004/0267395 | A1 | | 12/2004 | Discenzo et al. |
| 2005/0237021 | A1 | | 10/2005 | Sugano et al. |
| 2005/0252205 | A1 | | 11/2005 | Stavale et al. |

FOREIGN PATENT DOCUMENTS

| | | |
|---|---|---|
| DE | 4243118 | 6/1994 |
| WO | WO 2005/064167 | 7/2005 |

OTHER PUBLICATIONS

Three pages, German Office Action dated Jun. 26, 2009.
Two pages, English Translation of German Office Action dated Jun. 26, 2009.
DE4243118 English Translation.

* cited by examiner

*Primary Examiner* — Ryan A Jarrett

(57) ABSTRACT

The present invention provides an algorithm that utilizes flow reference data which can be mathematically determined as a function of various pump and motor parameters such as speed, torque or power or from calibrated flow curves stored in an evaluation device, or from an external flow reference such as a flowmeter. Once the PID control valve has reached its steady state condition a calculated flow value is captured and compared to the current flow value obtained after the variable frequency drive has decreased in frequency (speed). The valve position is optimized just prior to the speed threshold where the flow condition of the algorithm is no longer true.

32 Claims, 4 Drawing Sheets

The Basic Pump System

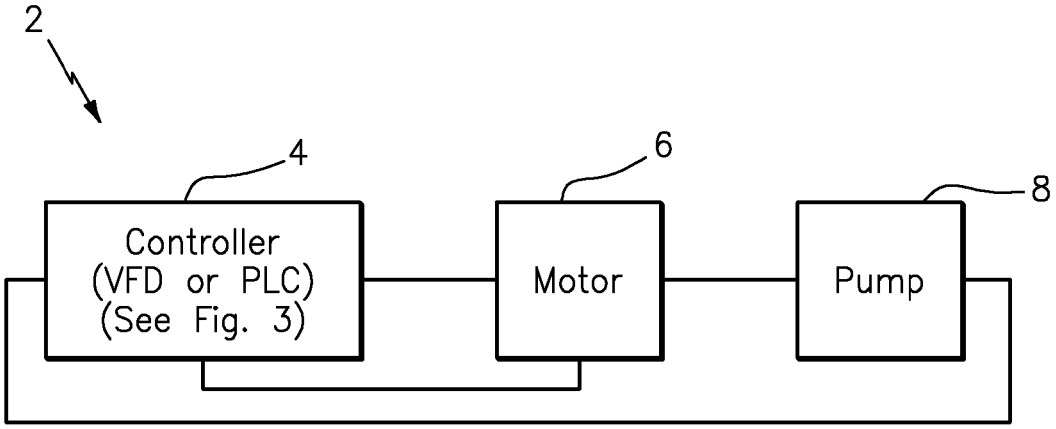
*FIG. 1*: The Basic Pump System
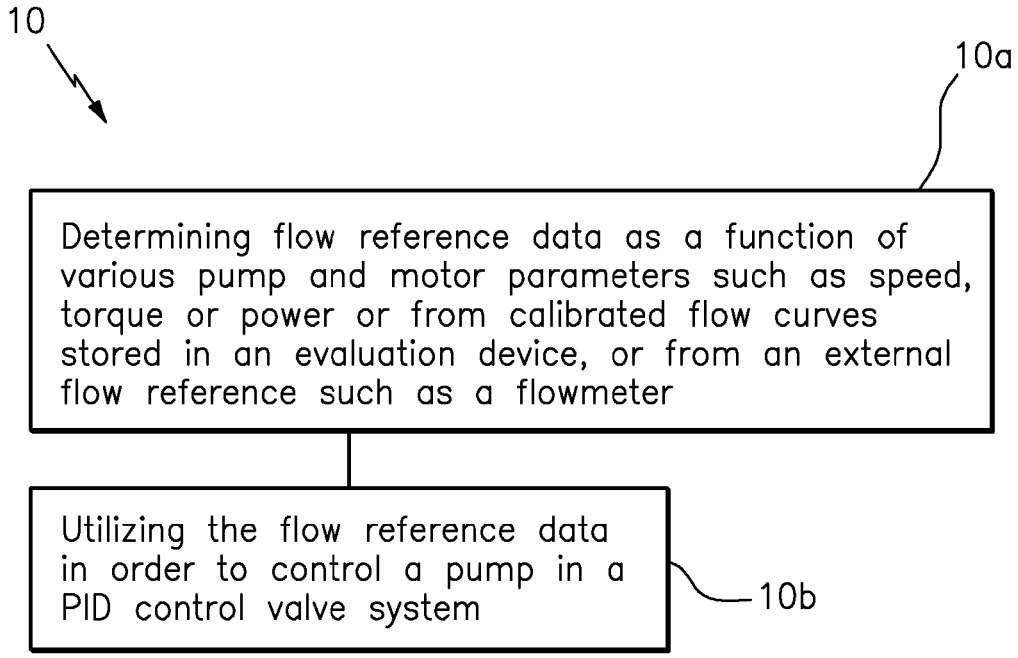
*FIG. 2*: The Basic Flowchart

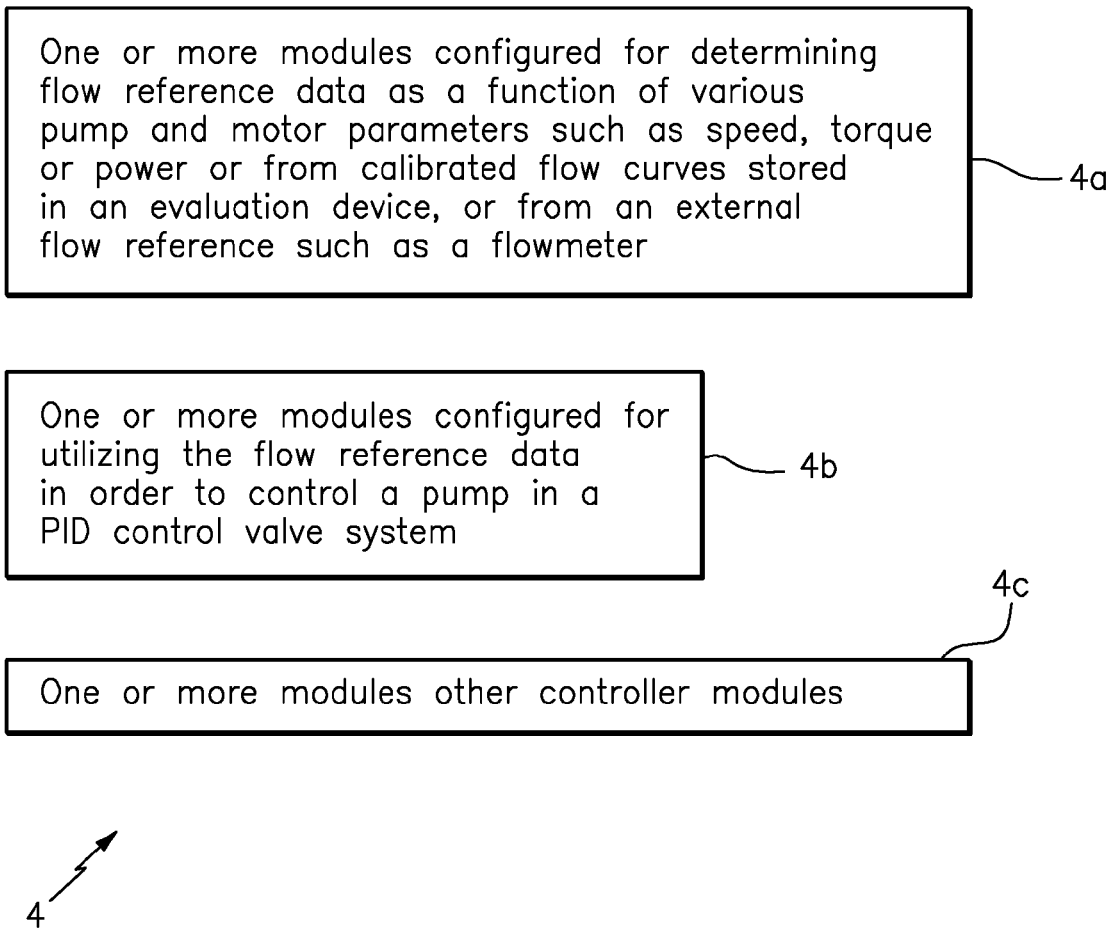
*FIG. 3*: The Controller 4

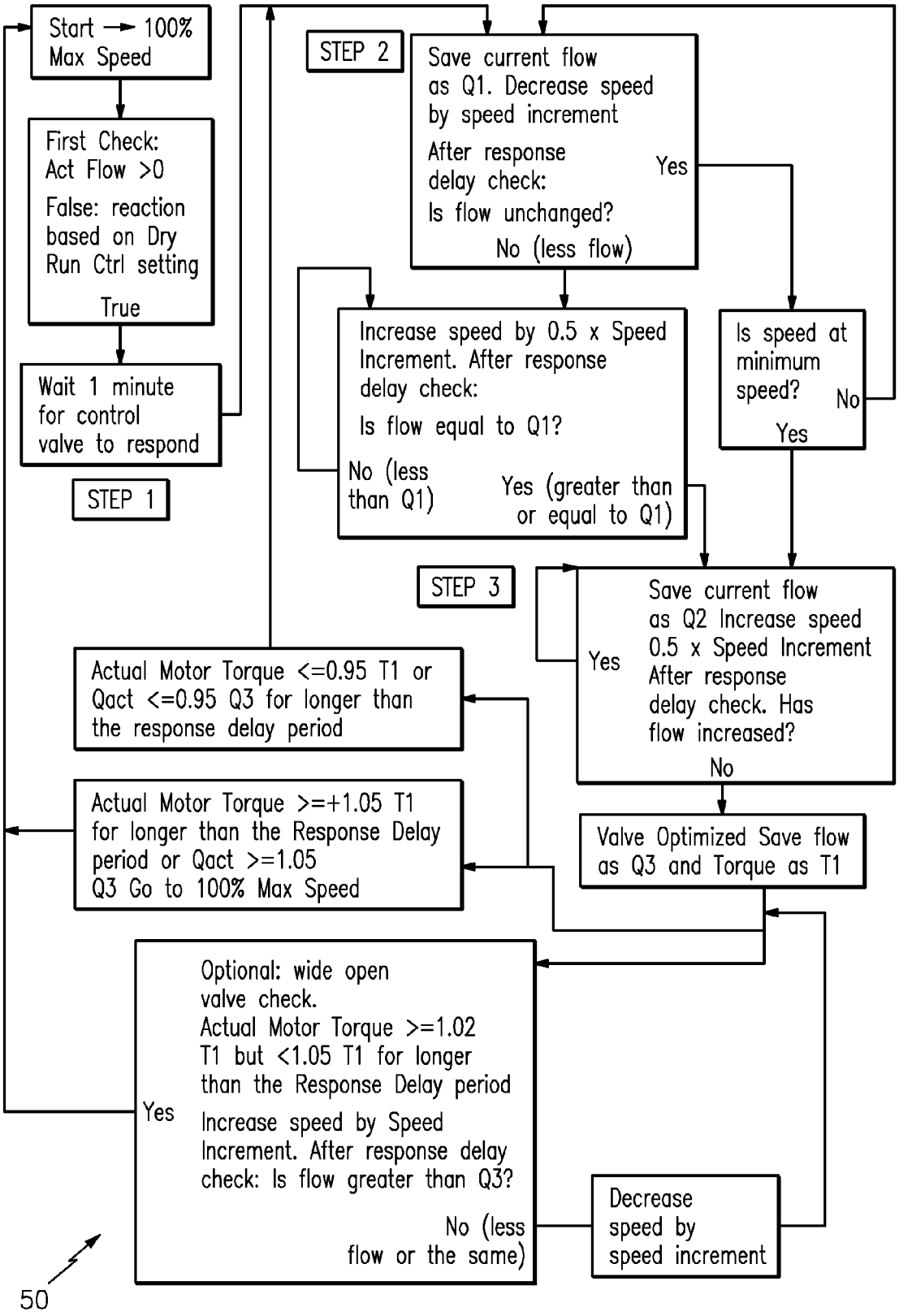
*FIG. 4* : Detailed Flowchart for Process Variable Set to Constant Flow Control applications

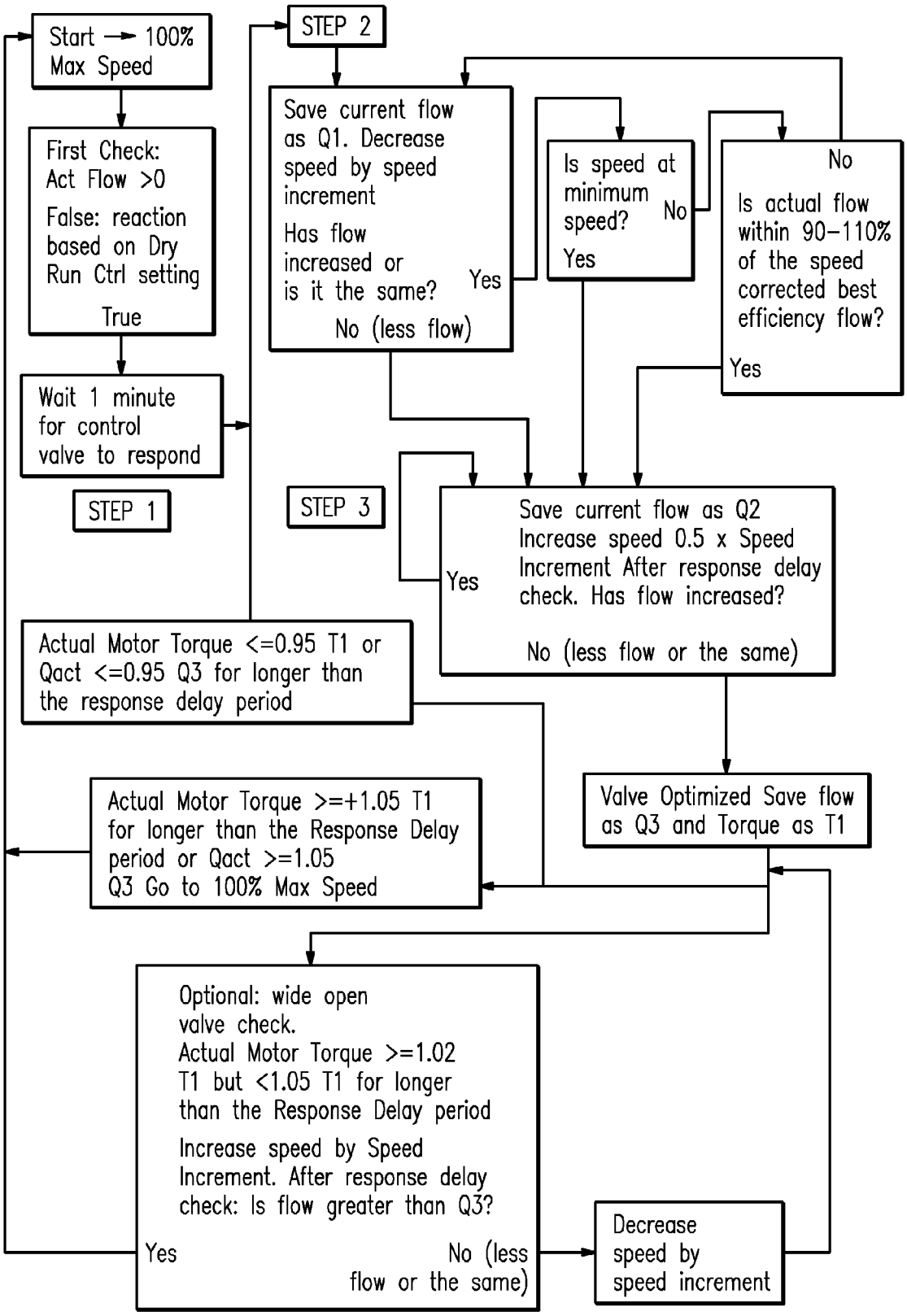
*FIG. 5* : Detailed Flowchart for Constant Pressure Control Applications

METHOD FOR OPTIMIZING VALVE POSITION AND PUMP SPEED IN A PID CONTROL VALVE SYSTEM WITHOUT THE USE OF EXTERNAL SIGNALS

CROSS-REFERENCE TO RELATED APPLICATIONS

This application claims benefit to provisional patent application Ser. No. 60/780,547, filed on 8 Mar. 2006, which is hereby incorporated by reference in its entirety.

The application is also related to patent application Ser. No. 11/636,355, filed Dec. 8, 2006, entitled "Method for determining pump flow without the use of traditional sensors," as well as patent application Ser. No. 11/601,373, entitled "Method and Apparatus for Pump Protection Without the Use of Traditional Sensors," filed 17 Nov. 2006, which are also both hereby incorporated by reference in their entirety.

BACKGROUND OF THE INVENTION

1. Field of the Invention

The present invention relates to a pump, including a centrifugal pump; and more particularly to a method and apparatus for optimizing valve position and pump speed in a PID control valve system without the use of external signals.

2. Brief Description of Related Art

Other similar devices and their shortcomings are as follows:

PCT WO 2005/064167 A1, entitled "Quantitative Measurement" by Witzel, Rolf et al., discloses methodology that uses a calibrated power/differential pressure curve vs. flow vs. speed. The calibrated data is stored and compared to current values in order to determine pump flow. However, while this technique can monitor pump power and differential pressure data to predict flow from a calibrated pump curve at various speeds, it cannot seek an optimal pump speed and valve position from a PID control valve system.

U.S. Pat. No. 6,591,697, issued to Henyan, entitled "Method for Determining Pump Flow Rates Using Motor Torque Measurements," discloses methodology that explains the relationship of torque and speed versus pump flow rate and the ability to regulate pump flow using a Variable Frequency Drive (VFD) to adjust centrifugal pump speed. While this technique can monitor the relationship of torque and speed versus pump flow rate and has the ability to regulate pump flow by using a variable frequency drive (VFD) to adjust centrifugal pump speed, it cannot seek an optimal pump speed and valve position from a PID control valve system.

U.S. Pat. No. 6,464,464 B2, issued to Sabini et al., entitled "Apparatus and Method for Controlling a Pump System," discloses methodology that explains a control and pump protection algorithm which uses a VFD to regulate flow, pressure or speed of a centrifugal pump. While this technique can regulate flow or pressure via a PID control loop embedded in a variable frequency drive (VFD) by using feedback from an external transmitter, it cannot seek an optimal speed and control valve position from a PID control valve system.

SUMMARY OF THE INVENTION

In its broadest sense, the present invention features a method and apparatus for determining flow reference data as a function of various pump and motor parameters such as speed, torque or power or from calibrated flow curves stored in an evaluation device, or from an external flow reference such as a flowmeter; and for utilizing the flow reference data in order to control a centrifugal pump, centrifugal blower, centrifugal mixer or centrifugal compressor in a PID control valve system. The apparatus may take the form of a controller or other suitable processing device for controlling the operation of the pump.

In effect, the present invention will overcome shortcomings of the above-mentioned prior art devices for pumping systems that utilize PID control valve logic to control the process where the input of valve data/position or other external signals is not desirable. The algorithm according to the present invention utilizes flow reference data which can be mathematically determined as a function of the various pump and motor parameters such as speed, torque or power or from calibrated flow curves stored in the evaluation device, or from the external flow reference such as a flowmeter.

Embodiments of the present invention may include one or more of the following features: Once the PID control valve has reached its steady state normal condition, a calculated flow value may be captured and compared to the current flow value obtained after the variable frequency drive has decreased in frequency (speed). For pressure control applications, the valve position may be optimized if the current flow is within 90-110% of the pump best efficiency flow at current speed. A final check may be made for a wide open control valve condition by increasing pump speed a set amount and comparing the current flow value to a saved flow value, and if there is no increase in flow the valve position is optimized. If the controller has already reached its optimized state, and if either the actual motor torque increases by 5% or greater, or the actual flow increases by 5% or greater for longer than the delay period, the valve optimization process may be restarted at maximum speed. Alternatively, if the controller has already reached its optimized state, and if either the actual motor torque decreases by 5% or more, or the actual flow decreases by 5% or more, the valve optimization process may be restarted at the current operating point. A secondary user selectable wide open valve check may be made if a change in actual motor torque is 2% or more but less than 5% of the optimized state for the response delay period, and if this condition is true and the actual flow is greater than the optimized flow value after a speed increment change, the optimization process may be restarted at maximum speed. Moreover, the valve position may be optimized just prior to the speed threshold where the flow condition of the algorithm is no longer true, or just prior to reaching minimum speed if the flow condition remains true, alone or together with one or more of the aforementioned features.

BRIEF DESCRIPTION OF THE DRAWING

FIG. 1 is a block diagram of a basic pump system according to the present invention.

FIG. 2 is a flowchart of basic steps performed according to the present invention by a controller shown in FIG. 1.

FIG. 3 is a block diagram of the controller shown in FIG. 1 having one or more modules configured for performing the basic steps shown in FIG. 2.

FIG. 4 shows a flow chart for a process variable set to constant flow control according to the present invention.

FIG. 5 shows a flow chart for constant pressure control applications according to the present invention.

DETAILED DESCRIPTION OF THE INVENTION

FIG. 1 shows the basic pump system generally indicated as 2 according to the present invention, having a controller 4, a motor 6 and a pump 8. In operation, and according to the present invention, the controller 4 provides for determining flow reference data as a function of various pump and motor parameters such as speed, torque or power or from calibrated flow curves stored in an evaluation device (not shown), or from an external flow reference such as a flowmeter (not shown); and for utilizing the flow reference data in order to control the pump 8, consistent with that shown and described herein.

FIG. 2 shows, by way of example, a flowchart generally indicated as 10 having the basic steps 10*a* and 10*b*, of the pump flow determination algorithm that may be implemented by the controller 4 according to the present invention. The determined flow value may also be used as an input to a PID control loop to control flow without an external flowmeter or traditional instrumentation. The flow determination algorithm may be embedded in a Variable Frequency Drive or Programmable Logic Controller like that shown above in relation to the controller 4 in FIG. 1.

FIG. 3: The Controller 4

FIG. 3 shows the basic modules 4*a*, 4*b*, 4*c* of the controller 4. Many different types and kind of controllers and control modules for controlling pumps are known in the art. Based on an understanding of such known controllers and control modules, a person skilled in the art would be able to implement control modules such as 4*a*, 4*b*, and configure the same to perform functionality consistent with that described herein, including determining flow reference data as a function of various pump and motor parameters such as speed, torque or power or from calibrated flow curves stored in an evaluation device (not shown), or from an external flow reference such as a flowmeter (not shown); and utilizing the flow reference data in order to control the pump 8, such as that shown in FIG. 1 and described above, in accordance with the present invention. The evaluation device, and/or the flowmeter may be included in, or form part of, the one or more module 4*a*, 4*b* or some combination thereof.

By way of example, the functionality of the modules 4*a*, 4*b* may be implemented using hardware, software, firmware, or a combination thereof, although the scope of the invention is not intended to be limited to any particular embodiment thereof. In a typical software implementation, such a module would be one or more microprocessor-based architectures having a microprocessor, a random access memory (RAM), a read only memory (ROM), input/output devices and control, data and address buses connecting the same. A person skilled in the art would be able to program such a microprocessor-based implementation to perform the functionality described herein without undue experimentation. The scope of the invention is not intended to be limited to any particular implementation using technology known or later developed in the future.

The controller 4 has other controller modules 4*c* that are known in the art, that do not form part of the underlying invention, and that are not described in detail herein. For example, the other control modules 4*c* may include such a evaluation device and/or such a flowmeter. Moreover, such evaluation devices for storing flow curves and/or the flowmeters for providing the external reference data are known in the art and not described in detail herein. Moreover, the scope of the invention is not intended to be limited to any particular type or kind thereof that is either now known or later developed in the future. Embodiments are envisioned in which the evaluation device and/or the flowmeter are included in, or form part of, the one or more control modules 4*a*, 4*b* as well.

The Motor 6 and Pump 8

The motor 6 and pump 8 are known in the art and not described in detail herein. Moreover, the scope of the invention is not intended to be limited to any particular type or kind thereof that is either now known or later developed in the future. Moreover still, the scope of the invention is also intended to include using the technique according to the present invention in relation to controlling the operation of a centrifugal pump, centrifugal mixer, centrifugal blower or centrifugal compressor.

The Implementation

There are many fixed speed centrifugal pump processes operating today with control valves in combination with a PID controller. In this arrangement a control valve is throttled to maintain the process setpoint by utilizing feedback from an external process transmitter and PID logic in a DCS (Distributed Control System), PLC (Programmable Logic Controller), or some other loop control device. In many cases the pump is oversized and the cost of valve throttling can be high from the standpoint of energy consumption. Additionally, if a fixed speed pump is operated further from its best efficiency flow the pump's radial and axial loads will increase. These increased loads can have a negative effect on bearing and seal life and serve to decrease system reliability which can result in unscheduled maintenance of the equipment. The costs associated with unscheduled maintenance include the repair of equipment, interruptions in production and/or costs associated with environmental cleanup.

It is therefore advantageous to operate a system where pump speed can be lowered so that valve throttling is minimized and the pump can operate as close as possible to its best efficiency flow.

Many users want the benefits of lower operating cost and increased system reliability but do not want to make any changes to their control logic or provide for external inputs. The invention solves this by using a variable speed drive (VFD) and control logic to attempt optimization of both pump speed and control valve position without requiring changes to the external control logic on the control valve. It also attempts to perform this without the use of external inputs. The logic is as follows:

The VFD Inputs to the Logic include:

Maximum Pump Speed,

Minimum Pump Speed,

Motor Torque, and

Motor Power.

In one form, the logic utilizes calculated flow data which can be mathematically determined from various pump and motor parameters such as speed, torque or power or from calibrated flow curves stored in an evaluation device. In practice however, this logic could be attempted using any drive operating parameter that has direct, or semi-direct relationship with pump flow. In addition, while this logic stresses the functionality without any external process signal, a direct reading of flow (from a flowmeter) could also be used. The logic can be embedded on either a variable frequency drive (VFD) or a programmable logic controller (PLC).

FIG. 4 shows a flow chart generally indicated as 50 for a process variable set to constant flow control, and FIG. 5 is for constant pressure control applications.

There are three steps in the valve optimization process as follows:

Step 1—The pump system is started and ramps to maximum speed. A check is made to be sure that the pump is not operating at zero flow—a potentially dangerous condition. If operating at zero flow the user has the option to fault the unit (shutdown) or send a warning to the operator. If flow is established the process goes to the next step after waiting one minute for the PID control valve to respond.

Step 2—The valve optimization process begins once the PID control valve has achieved the setpoint at the maximum pump speed setting following the expiration of the one minute delay period. The current flow value is saved as Q1. Next the pump is gradually slowed by a user adjustable speed increment at a user adjustable ramp rate. Once a response delay (user adjustable) has been met in order to give the control valve time to re-establish the setpoint a check is made to compare the current flow with Q1. If the flow is unchanged (constant flow only) or flow has increased or is the same (constant pressure only) the decrease in speed is iterated until either minimum pump speed is reached or the flow has decreased (constant flow only). If the flow has decreased the logic increases speed slightly by ½ the speed increment until the current flow equals or is greater than flow Q1 prior to going to step 3. This is important in high static head applications. In pressure control applications a check is made to see if the actual flow is within 90-110% of the best efficiency flow, the flow value is less than Q1 or minimum speed has been reached prior to going to step 3.

Step 3—The purpose of step 3 is to be sure that the control valve is not wide open. If this condition is "green" the pump speed and valve position are considered optimized. If there is a >=+5% change in motor torque or flow over the optimized values for longer than the response delay it is inferred that an increase in setpoint has occurred and the valve optimization process is restarted from maximum speed. If the change in motor torque or flow is >=−5% of the optimized torque or flow than it is inferred that the setpoint has been decreased and the valve optimization process begins at step 2. For certain applications a user may increase the setpoint when the control valve is already near open. This may not result in an accompanying >=5% change in motor torque. For this condition a user selectable feature is available to check for a wide open valve condition if there is a >=+2% change in motor torque (but less than 5%).

It should be noted that although calculated flow values have been used in the logic presented here; values of torque or power could also be substituted for flow. The logic continuously checks for dry running, minimum flow (flow too low) or runout conditions (flow too high) via the calculated flow value and will either warn the user or shutdown the unit and fault or automatically reset the fault and restart the unit (if configured this way) via the pump protection logic shown in provisional patent application file no. 60/780,529, filed 8 Mar. 2006, as well as the corresponding regular patent application Ser. No. 11/601,373, filed 17 Nov. 2006, which are both incorporated by reference in their entirety.

Other Possible Applications

Existing systems which utilize control valve logic where the setpoint is achieved by valve throttling, normally at a fixed motor speed. This logic embedded on a VFD or a PLC would enable the optimization of pump speed and control valve position to reduce operating costs and increase system reliability.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

We claim:

1. A controller comprising:

at least one module configured to determine flow reference data based at least partly on signalling containing information about various pump and motor parameters including speed, torque or power, or from calibrated flow curves stored in an evaluation device, or from an external flow reference including a flowmeter; and at least one module, which is configured to utilize the flow reference data in order to provide corresponding signalling containing information to control a centrifugal pump, centrifugal blower, centrifugal mixer or centrifugal compressor, driven via a variable frequency drive, in a PID control valve system, wherein, once a PID control valve has reached its steady state normal condition, a calculated flow value is captured and compared to a current flow value obtained after the variable frequency drive has decreased in frequency (speed).

2. A controller according to claim 1, wherein a valve position is optimized just prior to a speed threshold where a flow condition of an algorithm is no longer true.

3. A controller according to claim 1, wherein a valve position is optimized just prior to reaching minimum speed if a flow condition remains true.

4. A controller according to claim 1, wherein for pressure control applications a valve position is optimized if current flow is within 90-110% of a pump best efficiency flow at current speed.

5. A controller according to claim 1, wherein a final check is made for a wide open control valve condition by increasing pump speed a set amount and comparing the current flow value to a saved flow value, and if there is no increase in flow a valve position is optimized.

6. A controller according to claim 1, wherein if the controller has already reached its optimized state, and if either an actual motor torque increases by 5% or greater, or actual flow increases by 5% or greater for longer than a delay period, an valve optimization process is restarted at maximum speed.

7. A controller according to claim 1, wherein if the controller has already reached its optimized state, and if either an actual motor torque decreases by 5% or more, or actual flow decreases by 5% or more, a valve optimization process restarts at a current operating point.

8. A controller according to claim 1, wherein a secondary user selectable wide open valve check is made if a change in an actual motor torque is 2% or more but less than 5% of an optimized state for a response delay period, and if this condition is true and actual flow is greater than an optimized flow value after a speed increment change, an optimization process is restarted at maximum speed.

9. A method comprising:

determining in at least one module flow reference data as a function of various pump and motor parameters including speed, torque or power, or from calibrated flow curves stored in an evaluation device, or from an external flow reference including a flowmeter; and utilizing in at least one module the flow reference data in order to control a centrifugal pump centrifugal blower, centrifugal mixer or centrifugal compressor, driven via a variable frequency drive, in a PID control valve system, wherein, once a PID control valve has reached its steady state normal condition, a calculated flow value is captured and compared to a current flow value obtained after the variable frequency drive has decreased in frequency (speed).

10. A method according to claim 9, wherein a valve position is optimized just prior to a speed threshold where a flow condition of an algorithm is no longer true.

11. A method according to claim 9, wherein a valve position is optimized just prior to reaching minimum speed if a flow condition remains true.

12. A method according to claim 9, wherein for pressure control applications a valve position is optimized if current flow is within 90-110% of a pump best efficiency flow at current speed.

13. A method according to claim 9, wherein a final check is made for a wide open control valve condition by increasing pump speed a set amount and comparing the current flow value to a saved flow value, and if there is no increase in flow a valve position is optimized.

14. A method according to claim 9, wherein if the controller has already reached its optimized state, and if either an actual motor torque increases by 5% or greater, or actual flow increases by 5% or greater for longer than a delay period, a valve optimization process is restarted at maximum speed.

15. A method according to claim 9, if the controller has already reached its optimized state, and if either an actual motor torque decreases by 5% or more, or the actual flow decreases by 5% or more, the valve optimization process restarts at a current operating point.

16. A method according to claim 9, wherein a secondary user selectable wide open valve check is made if a change in an actual motor torque is 2% or more but less than 5% of an optimized state for a response delay period, and if this condition is true and actual flow is greater than an optimized flow value after a speed increment change, an optimization process is restarted at maximum speed.

17. A controller comprising:

at least one module configured to determine flow reference data based at least partly on signalling containing information about various pump and motor parameters including speed, torque or power, or from calibrated flow curves stored in an evaluation device, without using a flow sensor; and at least one module, which is configured to utilize the flow reference data in order to provide corresponding signalling containing information to control a centrifugal pump, centrifugal blower, centrifugal mixer or centrifugal compressor, driven via a variable frequency drive, in a PID control valve system, wherein, once a PID control valve has reached its steady state normal condition, a calculated flow value is captured and compared to a current flow value obtained after the variable frequency drive has decreased in frequency (speed).

18. A controller according to claim 17, wherein a valve position is optimized just prior to a speed threshold where a flow condition of an algorithm is no longer true.

19. A controller according to claim 17, wherein a valve position is optimized just prior to reaching minimum speed if a flow condition remains true.

20. A controller according to claim 17, wherein for pressure control applications a valve position is optimized if current flow is within 90-110% of a pump best efficiency flow at current speed.

21. A controller according to claim 17, wherein a final check is made for a wide open control valve condition by increasing pump speed a set amount and comparing the current flow value to a saved flow value, and if there is no increase in flow a valve position is optimized.

22. A controller according to claim 17, wherein if the controller has already reached its optimized state, and if either an actual motor torque increases by 5% or greater, or actual flow increases by 5% or greater for longer than a delay period, an valve optimization process is restarted at maximum speed.

23. A controller according to claim 17, wherein if the controller has already reached its optimized state, and if either an actual motor torque decreases by 5% or more, or actual flow decreases by 5% or more, a valve optimization process restarts at a current operating point.

24. A controller according to claim 17, wherein a secondary user selectable wide open valve check is made if a change in an actual motor torque is 2% or more but less than 5% of an optimized state for a response delay period, and if this condition is true and actual flow is greater than an optimized flow value after a speed increment change, an optimization process is restarted at maximum speed.

25. A method comprising:

determining in at least one module flow reference data based at least partly on signalling containing information about various pump and motor parameters including speed, torque or power, or from calibrated flow curves stored in an evaluation device, without using a flow sensor; and utilizing in at least one module the flow reference data in order to control a centrifugal pump, centrifugal blower, centrifugal mixer or centrifugal compressor, driven via a variable frequency drive, in a PID control valve system, wherein, once a PID control valve has reached its steady state normal condition, a calculated flow value is captured and compared to a current flow value obtained after the variable frequency drive has decreased in frequency (speed).

26. A method according to claim 25, wherein a valve position is optimized just prior to a speed threshold where a flow condition of an algorithm is no longer true.

27. A method according to claim 25, wherein a valve position is optimized just prior to reaching minimum speed if a flow condition remains true.

28. A method according to claim 25, wherein for pressure control applications a valve position is optimized if current flow is within 90-110% of a pump best efficiency flow at current speed.

29. A method according to claim 25, wherein a final check is made for a wide open control valve condition by increasing pump speed a set amount and comparing the current flow value to a saved flow value, and if there is no increase in flow a valve position is optimized.

30. A method according to claim 25, wherein if the controller has already reached its optimized state, and if either an actual motor torque increases by 5% or greater, or actual flow increases by 5% or greater for longer than a delay period, a valve optimization process is restarted at maximum speed.

31. A method according to claim 25, if the controller has already reached its optimized state, and if either an actual motor torque decreases by 5% or more, or actual flow decreases by 5% or more, the valve optimization process restarts at a current operating point.

32. A method according to claim 25, wherein a secondary user selectable wide open valve check is made if a change in an actual motor torque is 2% or more but less than 5% of an optimized state for a response delay period, and if this condition is true and actual flow is greater than an optimized flow value after a speed increment change, an optimization process is restarted at maximum speed.

* * * * *